US011219320B2

(12) United States Patent
Schumacher et al.

(10) Patent No.: US 11,219,320 B2
(45) Date of Patent: Jan. 11, 2022

(54) ELECTRONIC SHELVING SYSTEMS, CABLE-MANAGING COUPLING BRACKETS, AND METHODS THEREOF

(71) Applicant: Adroit Worldwide Media, Inc., Aliso Viejo, CA (US)

(72) Inventors: Greg Schumacher, Aliso Viejo, CA (US); Kevin Howard, Aliso Viejo, CA (US); David Alstatt, Aliso Viejo, CA (US); Cody Tanner, Aliso Viejo, CA (US); Kurtis Van Horn, Aliso Viejo, CA (US)

(73) Assignee: Adroit Worldwide Media, Inc., Aliso Viejo, CA (US)

( * ) Notice: Subject to any disclaimer, the term of this patent is extended or adjusted under 35 U.S.C. 154(b) by 221 days.

(21) Appl. No.: 16/562,946

(22) Filed: Sep. 6, 2019

(65) Prior Publication Data

US 2020/0077814 A1 Mar. 12, 2020

Related U.S. Application Data

(60) Provisional application No. 62/783,745, filed on Dec. 21, 2018, provisional application No. 62/728,742, filed on Sep. 7, 2018.

(51) Int. Cl.
*A47F 5/00* (2006.01)
*H01R 13/518* (2006.01)
(Continued)

(52) U.S. Cl.
CPC ..... *A47F 5/0018* (2013.01); *A47F 5/0043* (2013.01); *G09F 9/33* (2013.01);
(Continued)

(58) Field of Classification Search
CPC ..... A47F 5/0018; A47F 5/0043; A47F 11/10; A47F 2220/0077; A47F 5/103;
(Continued)

(56) References Cited

U.S. PATENT DOCUMENTS 5,348,485 A 9/1994 Briechle et al.
7,348,488 B2 3/2008 Benito-Navazo
(Continued)

OTHER PUBLICATIONS

International Search Report and Written Opinion, PCT Application No. PCT/US2019/050014, dated Nov. 8, 2019.

*Primary Examiner* — Travis S Chambers
(74) *Attorney, Agent, or Firm* — Ravi Mohan; Rutan & Tucker, LLP

(57) ABSTRACT

Disclosed herein is an electronic shelving system including, in some embodiments, a shelving unit and one or more coupling brackets. Each coupling bracket includes a bracket-coupling body, one or more power couplers disposed in the bracket-coupling body, one or more data couplers disposed in the bracket-coupling body, and one or more integral fasteners such as a tongue extending from the bracket-coupling body configured for fastening the coupling bracket to the shelving unit. Also disclosed herein is a method for the electronic shelving system including, in some embodiments, installing n coupling brackets in the shelving unit, running at least n+1 power cables or data cables through a slotted cable raceway of the shelving unit, and coupling at least two power cables or data cables to each other by way of the coupling bracket.

12 Claims, 6 Drawing Sheets

(51) Int. Cl.

| | |
|---|---|
| ***G09F 9/33*** | (2006.01) |
| ***H01R 4/64*** | (2006.01) |
| ***H01R 25/14*** | (2006.01) |
| *A47F 11/10* | (2006.01) |

(52) U.S. Cl.
CPC ..... *H01R 4/64* (2013.01); *H01R 13/518* (2013.01); *H01R 25/14* (2013.01); *A47F 11/10* (2013.01)

(58) Field of Classification Search
CPC .. A47F 3/001; G09F 9/33; H01R 4/64; H01R 25/14; H01R 13/518; H01R 24/76; H01R 24/64; H01R 4/54; H01R 25/16; H01R 25/142; H01R 31/06
See application file for complete search history.

(56) References Cited

U.S. PATENT DOCUMENTS

| | | | | |
|---|---|---|---|---|
| 9,130,327 | B2 | 9/2015 | Flynn et al. | |
| 9,883,756 | B2 * | 2/2018 | Kraiss | A47F 11/10 |
| 9,990,644 | B2 | 6/2018 | Walden | |
| 10,373,189 | B2 | 8/2019 | Walden | |
| 10,373,190 | B2 | 8/2019 | Walden | |
| 10,732,026 | B1 * | 8/2020 | Danenberg | G01G 21/00 |
| 2008/0043456 | A1 * | 2/2008 | Bernardini | F25D 25/02 362/94 |
| 2014/0235093 | A1 | 8/2014 | Harlan et al. | |
| 2014/0249928 | A1 | 9/2014 | McMillan et al. | |
| 2016/0371735 | A1 | 12/2016 | Walden | |
| 2017/0011427 | A1 | 1/2017 | Walden | |
| 2017/0011429 | A1 | 1/2017 | Walden | |
| 2017/0017290 | A1 | 1/2017 | Walden | |
| 2017/0017994 | A1 | 1/2017 | Walden | |
| 2017/0018004 | A1 | 1/2017 | Walden | |
| 2017/0018005 | A1 | 1/2017 | Walden | |
| 2017/0018006 | A1 | 1/2017 | Walden | |
| 2017/0019764 | A1 | 1/2017 | Walden | |
| 2017/0053315 | A1 | 2/2017 | Walden | |
| 2017/0053316 | A1 | 2/2017 | Walden | |
| 2017/0068978 | A1 | 3/2017 | Walden | |

* cited by examiner

ELECTRONIC SHELVING SYSTEMS, CABLE-MANAGING COUPLING BRACKETS, AND METHODS THEREOF

PRIORITY

This application claims the benefit of priority to U.S. Provisional Patent Application No. 62/728,742, filed Sep. 7, 2018, and U.S. Provisional Patent Application No. 62/783,745, filed Dec. 21, 2018, each of which is incorporated by reference in its entirety into this application.

BACKGROUND

Retail environments are ever challenging. Consumers are continuously confronted with overwhelming amounts of information for competing brands of products. Such information is often provided on product shelving in some printed form such as on printed slide-in or adhesive shelf tags that include product information and pricing. However, such shelf tags can be difficult to read in retail environments, and the shelf tags are not always timely updated when a product is sold out or replaced with another product in the same shelf slot. That, and such information presented in the foregoing way does not create a particularly intimate customer experience. Therefore, a continuing need exists for solutions that help retailers create intimate customer experiences, as well as increase operational efficiencies. Disclosed herein are electronic shelving systems, cable-managing coupling brackets, and methods thereof.

SUMMARY

Disclosed herein is a coupling bracket for an electronic shelving system including, in some embodiments, a bracket-coupling body, one or more power couplers disposed in the bracket-coupling body, one or more data couplers disposed in the bracket-coupling body, and one or more integral fasteners extending from the bracket-coupling body configured for fastening the coupling bracket to a shelving unit of the electronic shelving system.

In some embodiments, the bracket-coupling body is 'U'-shaped with an end piece between two side pieces.

In some embodiments, the one or more power couplers and the one or more data couplers are disposed in the end piece of the bracket-coupling body.

In some embodiments, each side piece of the two side pieces includes an integrated cable comb with slots configured to receive one or more cables.

In some embodiments, a power-coupler side piece of the two side pieces is adjacent at least one of the one or more power couplers, and wherein the power-coupler side piece includes a relatively wide-toothed cable comb configured to receive one or more power cables.

In some embodiments, a data-coupler side piece of the two side pieces is adjacent at least one of the one or more data couplers, and wherein the data-coupler side piece includes a relatively narrow-toothed cable comb configured to receive one or more data cables.

In some embodiments, the one or more integral fasteners is a tongue configured to be inserted into a slot of a slotted cable raceway of a shelving unit of the electronic shelving system.

Also disclosed herein is an electronic shelving system including, in some embodiments, a shelving unit of the electronic shelving system and one or more coupling brackets of the electronic shelving system. Each coupling bracket includes a bracket-coupling body, one or more power couplers disposed in the bracket-coupling body, one or more data couplers disposed in the bracket-coupling body, and one or more integral fasteners extending from the bracket-coupling body configured for fastening the coupling bracket to the shelving unit of the electronic shelving system.

In some embodiments, the shelving unit includes at least a pair of shelving standards configured to hold brackets for shelves or shelves with integrated brackets and at least one slotted cable raceway between the pair of shelving standards.

In some embodiments, the one or more integral fasteners is a tongue configured to be inserted into any slot of the slotted cable raceway of the shelving unit.

In some embodiments, an end portion of the tongue is angled away from the bracket-coupling body to facilitate insertion of the tongue into the slot of the slotted cable raceway of the shelving unit.

In some embodiments, the bracket-coupling body is 'U'-shaped with an end piece between two side pieces.

In some embodiments, the one or more power couplers and the one or more data couplers are disposed in the end piece of the bracket-coupling body.

In some embodiments, each side piece of the two side pieces includes an end portion having a cutaway to facilitate fastening the coupling bracket to the shelving unit of the electronic shelving system.

In some embodiments, each side piece of the two side pieces includes an integrated cable comb with slots configured to receive one or more cables.

In some embodiments, a power-coupler side piece of the two side pieces is adjacent at least one of the one or more power couplers, and wherein the power-coupler side piece includes a relatively wide-toothed cable comb configured to receive one or more power cables.

In some embodiments, a data-coupler side piece of the two side pieces is adjacent at least one of the one or more data couplers, and wherein the data-coupler side piece includes a relatively narrow-toothed cable comb configured to receive one or more data cables.

Also disclosed herein is a method for an electronic shelving system including, in some embodiments, installing n coupling brackets in a shelving unit of the electronic shelving system. Each coupling bracket of the n coupling brackets includes a bracket-coupling body with one or more power couplers and one or more data couplers disposed therein. The shelving unit includes at least one slotted cable raceway between a pair of shelving standards of the shelving unit. The method further includes running at least n+1 power cables or data cables through the slotted cable raceway of the shelving unit and coupling i) at least two power cables to each other through a power coupler of a coupling bracket or ii) at least two data cables to each other through a data coupler of the coupling bracket.

In some embodiments, each coupling bracket of the n coupling brackets further includes a tongue integral with the bracket-coupling body. Installing the n coupling brackets includes inserting the tongue of each coupling bracket into a slot of the slotted cable raceway of the shelving unit.

In some embodiments, each coupling bracket of the n coupling brackets further includes a power-coupler side piece of the bracket-coupling body having a relatively wide-toothed cable comb and data-coupler side piece of the bracket-coupling body having a relatively narrow-toothed cable comb. Coupling the at least two power cables or data cables to each other includes threading an end portion of a power cable through the relatively wide-toothed cable comb or an end portion of a data cable through the relatively narrow-toothed cable comb.

These and other features of the concepts provided herein will become more apparent to those of skill in the art in view of the accompanying drawings and following description, which disclose particular embodiments of such concepts in greater detail.

DRAWINGS

DESCRIPTION

Figure 1A:
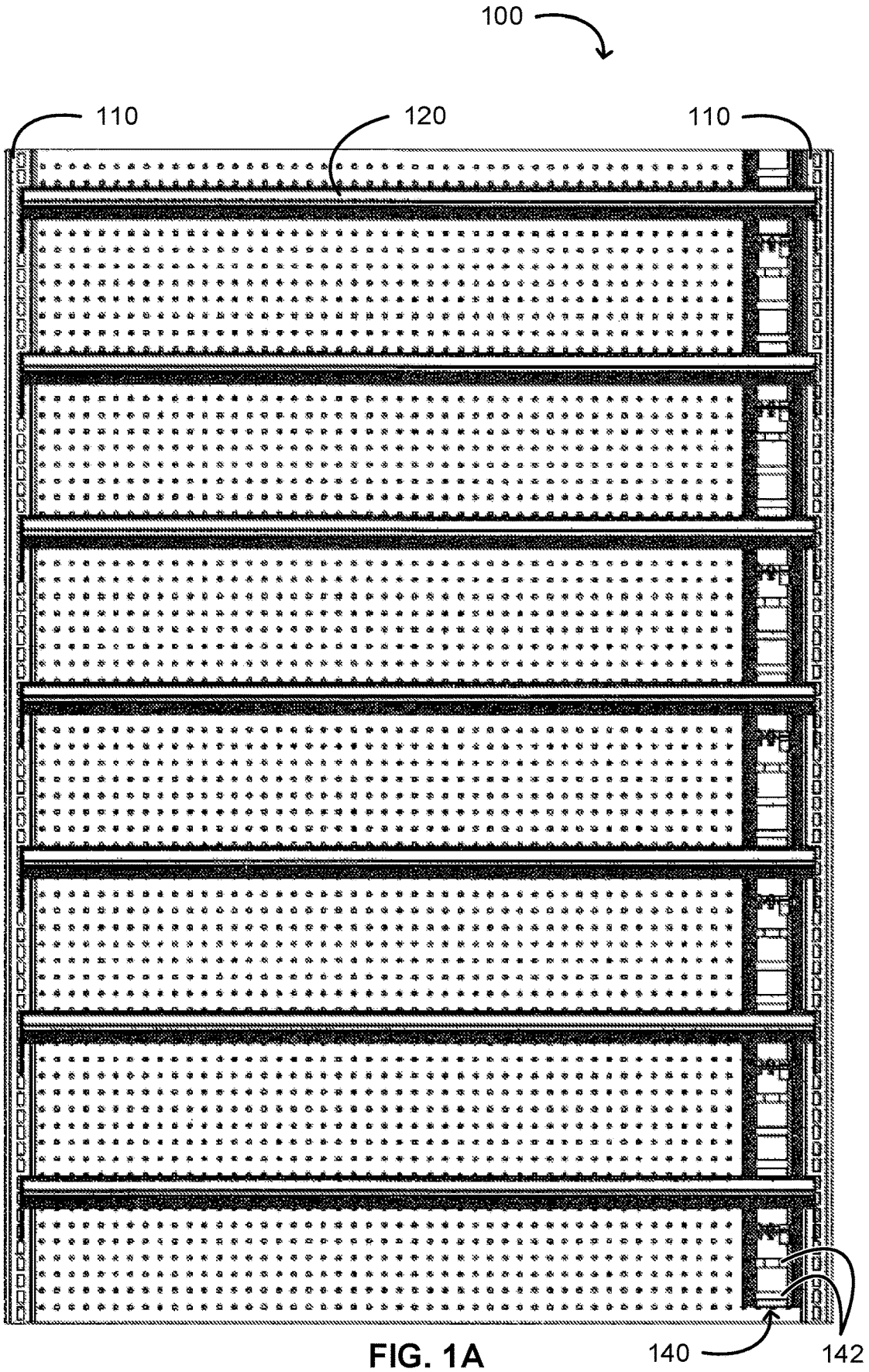
FIG. 1A illustrates a first view of a shelving unit of an electronic shelving system in accordance with some embodiments.

Before some particular embodiments are disclosed in greater detail, it should be understood that the particular embodiments disclosed herein do not limit the scope of the concepts provided herein. It should also be understood that a particular embodiment disclosed herein can have features that can be readily separated from the particular embodiment and optionally combined with or substituted for features of any of a number of other embodiments disclosed herein.

Regarding terms used herein, it should also be understood the terms are for the purpose of describing some particular embodiments, and the terms do not limit the scope of the concepts provided herein. Ordinal numbers (e.g., first, second, third, etc.) are generally used to distinguish or identify different features or steps in a group of features or steps, and do not supply a serial or numerical limitation. For example, "first," "second," and "third" features or steps need not necessarily appear in that order, and the particular embodiments including such features or steps need not necessarily be limited to the three features or steps. Labels such as "left," "right," "front," "back," "top," "bottom," and the like are used for convenience and are not intended to imply, for example, any particular fixed location, orientation, or direction. Instead, such labels are used to reflect, for example, relative location, orientation, or direction. Singular forms of "a," "an," and "the" include plural references unless the context clearly dictates otherwise.

Unless defined otherwise, all technical and scientific terms used herein have the same meaning as commonly understood by those of ordinary skill in the art.

Again, retail environments are ever challenging. Consumers are continuously confronted with overwhelming amounts of information for competing brands of products. Such information is often provided on product shelving in some printed form such as on printed slide-in or adhesive shelf tags that include product information and pricing. However, such shelf tags can be difficult to read in retail environments, and the shelf tags are not always timely updated when a product is sold out or replaced with another product in the same shelf slot. That, and such information presented in the foregoing way does not create a particularly intimate customer experience. Therefore, a continuing need exists for solutions that help retailers create intimate customer experiences, as well as increase operational efficiencies. Disclosed herein are electronic shelving systems, cable-managing coupling brackets, and methods thereof.

For example, an electronic shelving system is disclosed. In some embodiments, the electronic shelving system includes a shelving unit and one or more coupling brackets. Each coupling bracket includes a bracket-coupling body, one or more power couplers disposed in the bracket-coupling body, one or more data couplers disposed in the bracket-coupling body, and one or more integral fasteners such as a tongue extending from the bracket-coupling body configured for fastening the coupling bracket to the shelving unit. In another example, a method for the electronic shelving system is disclosed. In some embodiments, the method includes installing n coupling brackets in the shelving unit, running at least n+1 power cables or data cables through a slotted cable raceway of the shelving unit, and coupling at least two power cables or data cables to each other by way of the coupling bracket.

Shelving Units

Figure 1B:
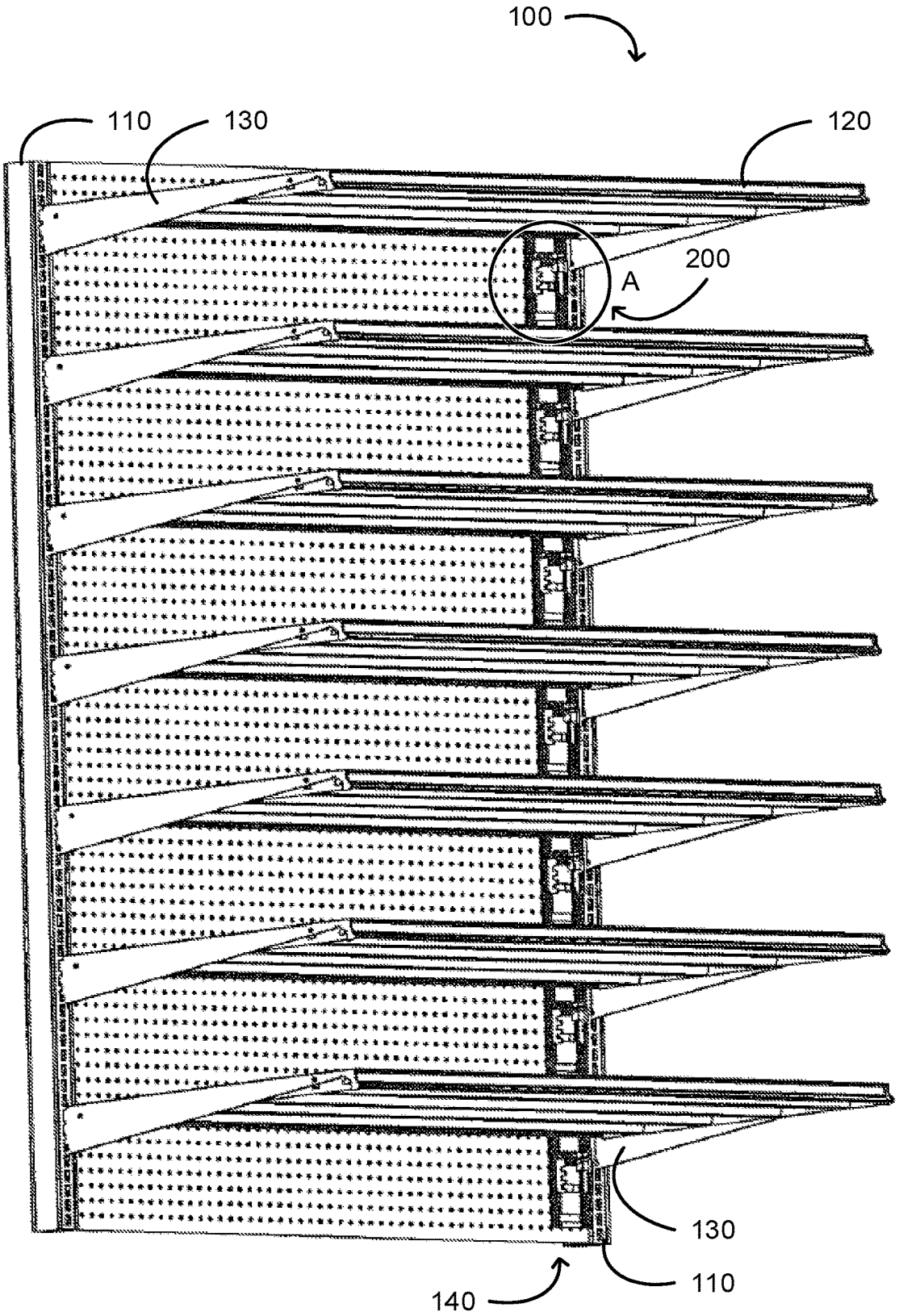
FIG. 1B illustrates a second view of the shelving unit of FIG. 1A in accordance with some embodiments.
Figure 2:
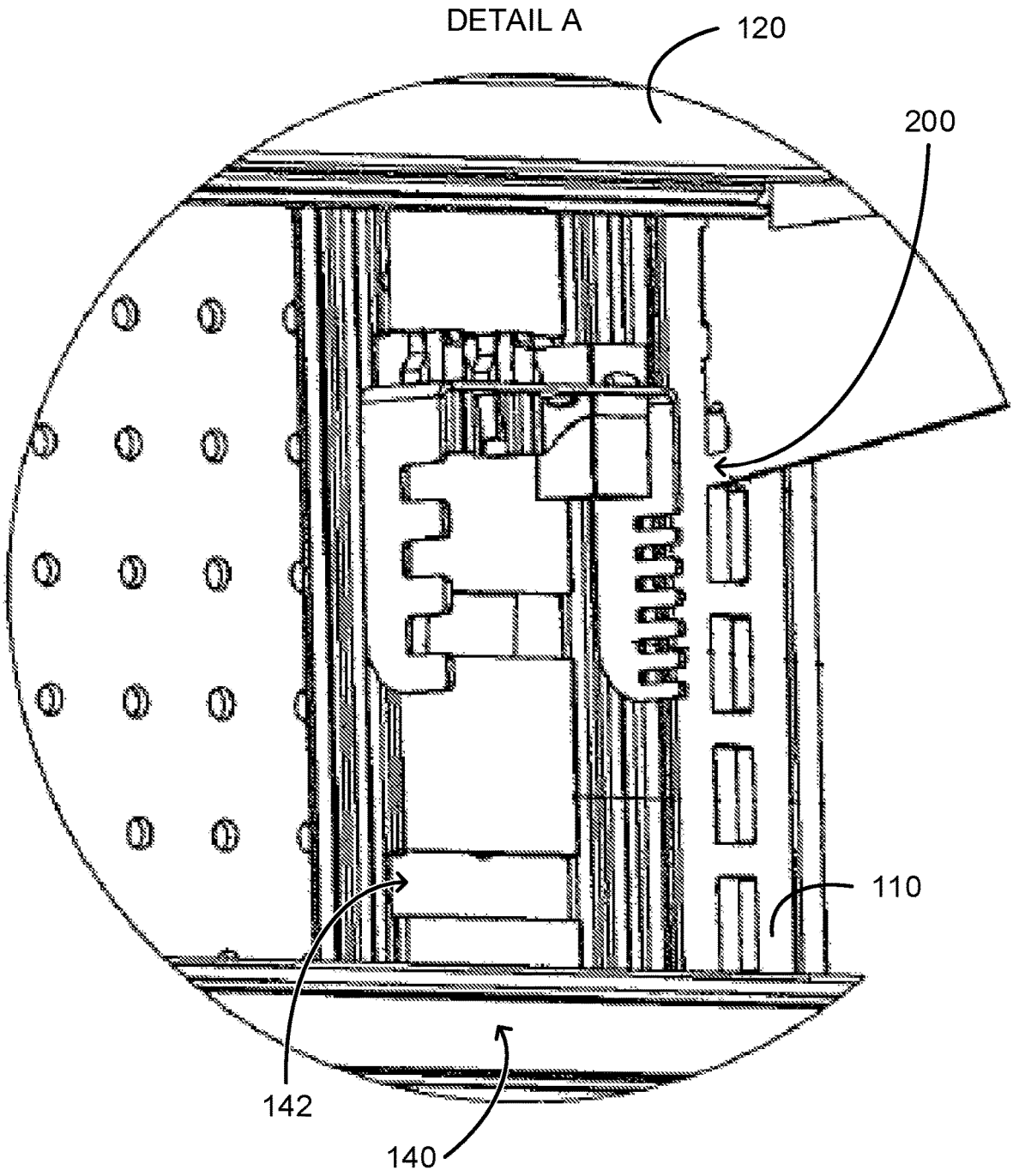
FIG. 2 illustrates a coupling bracket in the shelving unit of FIG. 1A in accordance with some embodiments.

FIG. 1A illustrates a first view of a shelving unit 100 of an electronic shelving system in accordance with some embodiments. FIG. 1B illustrates a second view of the shelving unit 100 of FIG. 1A in accordance with some embodiments. FIG. 2 illustrates a coupling bracket 200 in the shelving unit 100 of FIG. 1A in accordance with some embodiments.

As shown, an electronic shelving system can include the shelving unit 100 and one or more coupling brackets such as the coupling bracket 200. The shelving unit 100 can include at least a pair of shelving standards 110 configured to hold brackets 130 for shelves 120 (or shelves with integrated brackets) and at least one slotted cable raceway 140 between the pair of shelving standards 110 and parallel thereto.

While the coupling bracket 200 is described in more detail below with respect to FIGS. 3A-3G, each coupling bracket of the one or more coupling brackets can form a part of a cable management system, which cable management system can also include at least the slotted cable raceway 140 of the shelving unit 100. As part of the cable management system, the coupling bracket 200 can include one or more power couplers 220 disposed in a bracket-coupling body 210, one or more data couplers 230 disposed in the bracket-coupling body 210, and one or more integral fasteners such as a tongue 240 extending from the bracket-coupling body 210. (See FIGS. 3A-3G.) The tongue 240 can be configured for fastening the coupling bracket 200 to the shelving unit 100 of the electronic shelving system such as by inserting the tongue 240 into any slot 142 of the slotted cable raceway 140 of the shelving unit 100.

Coupling Brackets

Figure 3A:
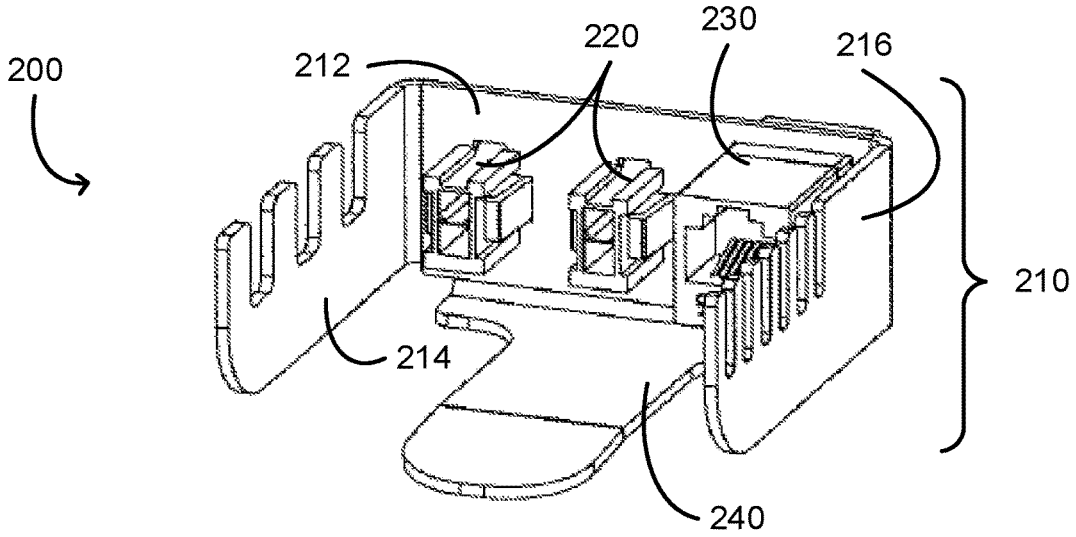
FIG. 3A illustrates a first view of a coupling bracket of the electronic shelving system in accordance with some embodiments.
Figure 3B:
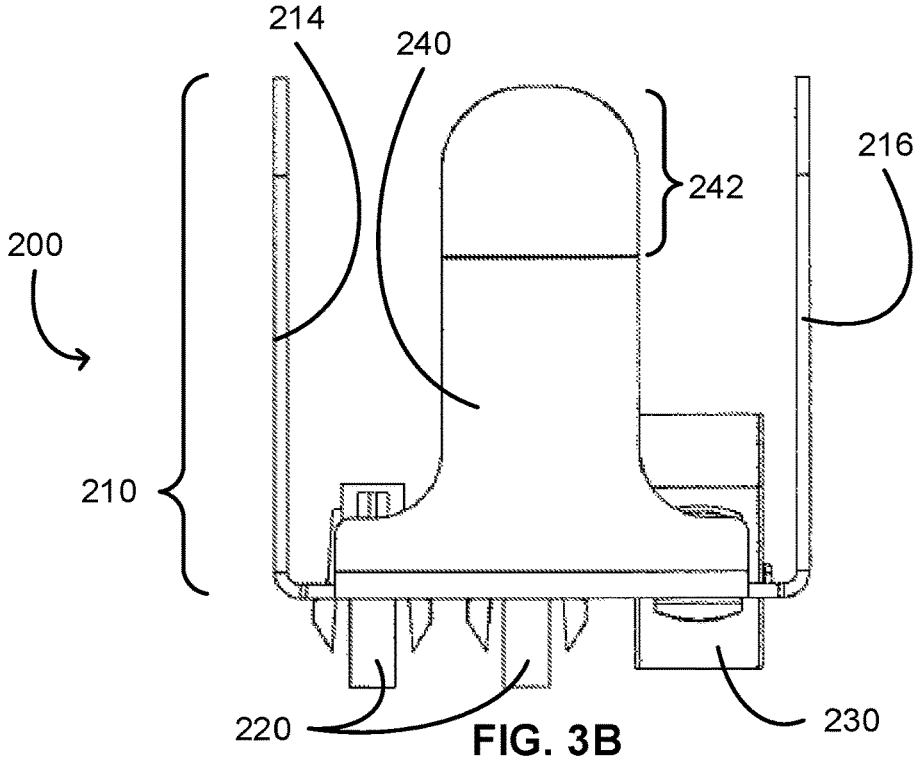
FIG. 3B illustrates a second view of the coupling bracket of FIG. 3A in accordance with some embodiments.
Figure 3C:
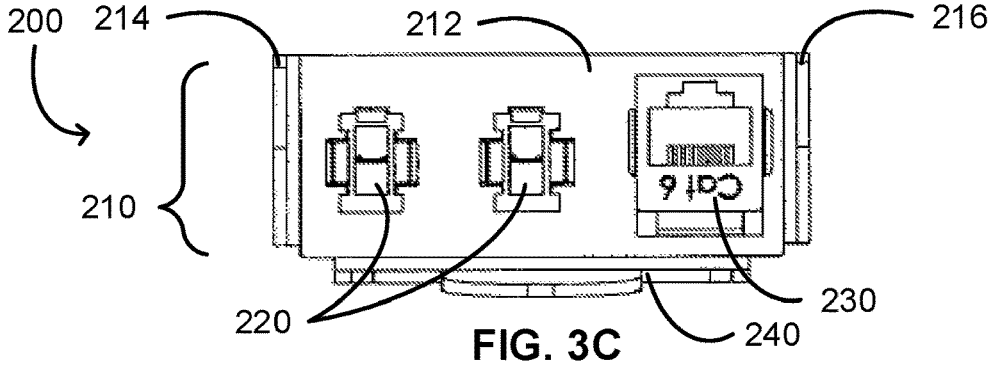
FIG. 3C illustrates a third view of the coupling bracket of FIG. 3A in accordance with some embodiments.
Figure 3G:
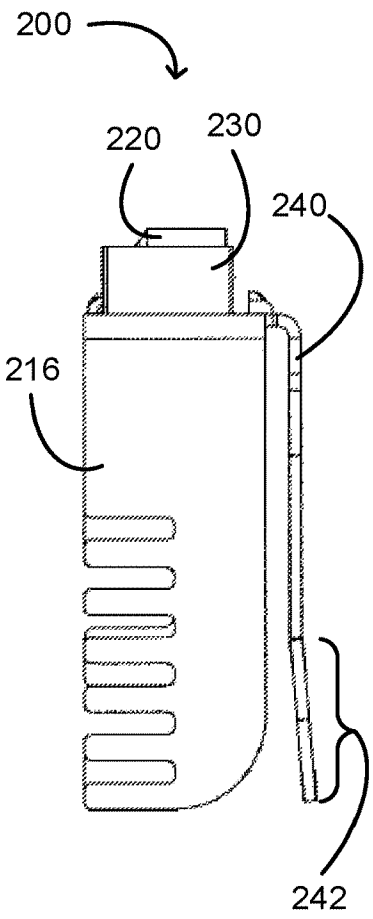
FIG. 3G illustrates a fifth view of the coupling bracket of FIG. 3A in accordance with some embodiments.
Figure 3F:
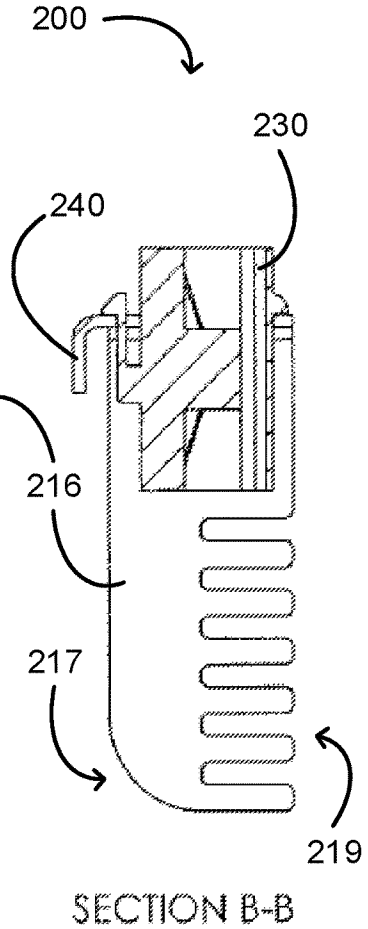
FIG. 3F illustrates a second cross-sectional view of the coupling bracket of FIG. 3D in accordance with some embodiments.
Figure 3D:
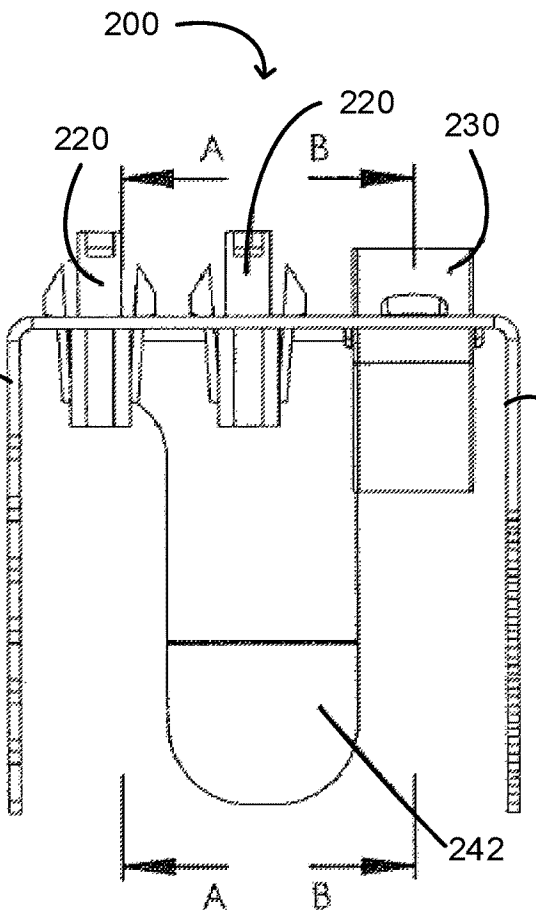
FIG. 3D illustrates a fourth view of the coupling bracket of FIG. 3A in accordance with some embodiments.
Figure 3E:
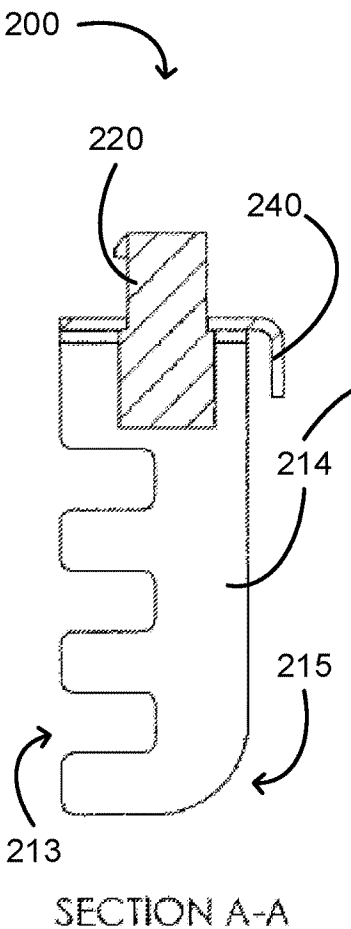
FIG. 3E illustrates a first cross-sectional view of the coupling bracket of FIG. 3D in accordance with some embodiments.

FIGS. 3A, 3B, 3C, 3D, and 3G illustrate various views of the coupling bracket 200 of the electronic shelving system in accordance with some embodiments. FIGS. 3E and 3F illustrate two cross-sectional views of the coupling bracket 200 of FIG. 3D in accordance with some embodiments.

As shown, the coupling bracket 200 can include the bracket-coupling body 210, the one or more power couplers 220 disposed in the bracket-coupling body 210, the one or more data couplers 230 disposed in the bracket-coupling body 210, and the one or more integral fasteners such as the tongue 240 extending from the bracket-coupling body 210.

The bracket-coupling body 210 can be 'U'-shaped with an end piece 212 between two side pieces 214 and 216. The one or more power couplers 220 and the one or more data couplers 230 can be disposed in the end piece 212 of the bracket-coupling body 210.

Each side piece of the two side pieces 214 and 216 of the 'U'-shaped bracket-coupling body 210 can include an integrated cable comb 213 or 219 with slots configured to receive one or more cables. A power-coupler side piece 214 of the two side pieces 214 and 216 can be adjacent at least one power coupler of the one or more power couplers 220. The power-coupler side piece 214 can include the cable comb 213, which can be a relatively wide-toothed cable comb, configured to receive one or more power cables. Threading an end portion of a power cable through the relatively wide-toothed cable comb 213 can mitigate tensile stress placed on the power coupler to which the power cable is attached from the weight of the power cable or inadvertent pulling of the power cable by an individual. A data-coupler side piece 216 of the two side pieces 214 and 216 can be adjacent at least one data coupler of the one or more data couplers 230. The data-coupler side piece 216 can include the cable comb 219, which can be a relatively narrow-toothed cable comb 219, configured to receive one or more data cables. Threading an end portion of a data cable through the relatively narrow-toothed cable comb 219 can mitigate tensile stress placed on the data coupler to which the data cable is attached from the weight of the data cable or inadvertent pulling of the data cable by an individual.

Each side piece of the two side pieces 214 and 216 of the 'U'-shaped bracket-coupling body 210 can also include an end portion having a cutaway 215 or 217, which can facilitate fastening the coupling bracket 200 to the shelving unit 100.

The one or more integral fasteners such as the tongue 240 can extend from the bracket-coupling body 210 for fastening the coupling bracket 200 to the shelving unit 100. As best shown in FIG. 3G, an end portion 242 of the tongue 240 can be angled away from the bracket-coupling body 210 to facilitate insertion of the tongue 240 into the slot 142 of the slotted cable raceway 140 of the shelving unit 100. Indeed, the angled end portion 242 of the tongue 240 combined with the cutaways 215 and 217 of the two side pieces 214 and 216, respectively, further facilitate fastening the coupling bracket 200 to the shelving unit 100.

The coupling bracket 200 can be molded by way of compression molding using either a thermoplastic or thermoset stock material in a granular or pelletized form.

Electronic Shelving Systems

Figure 4:
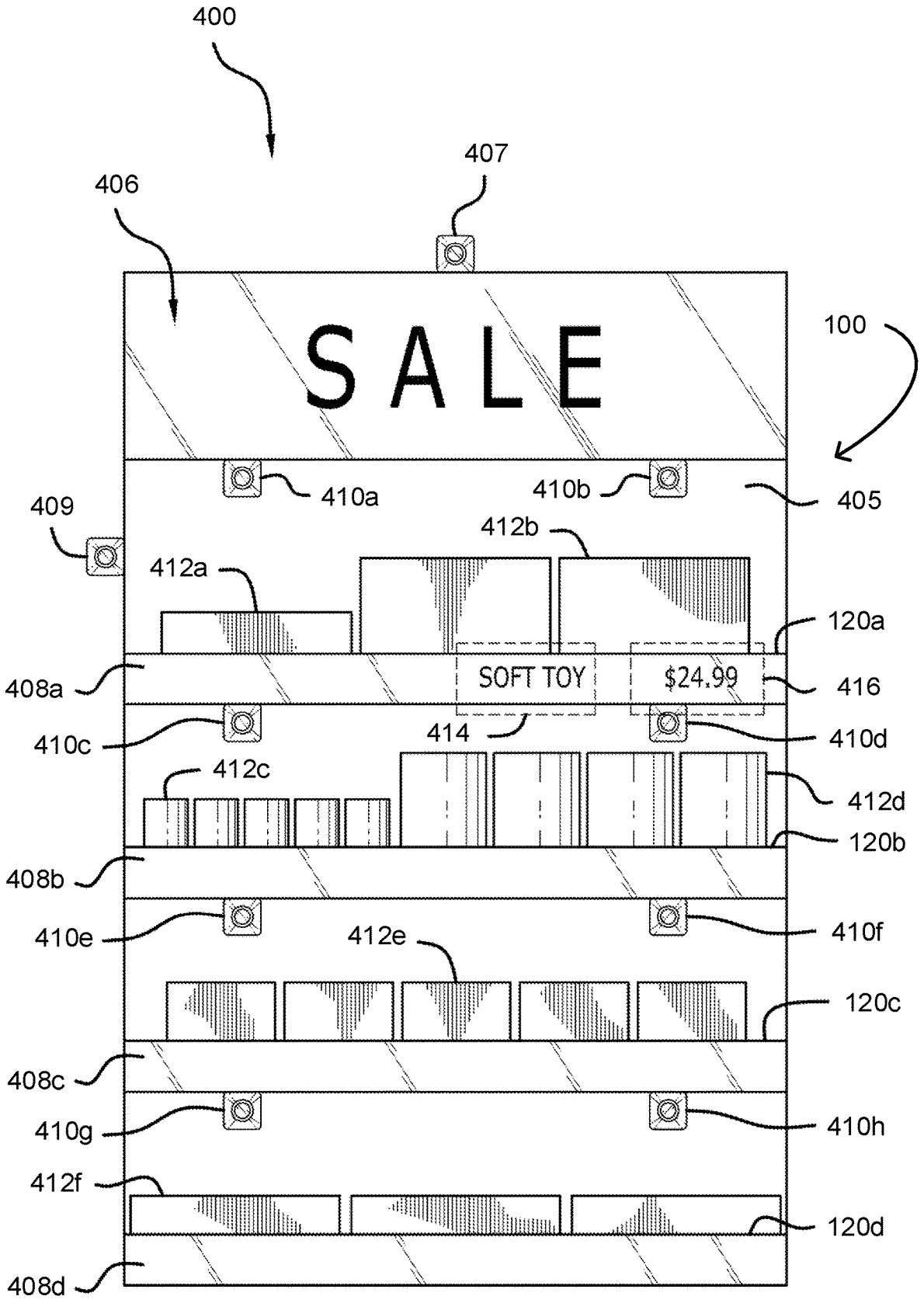
FIG. 4 illustrates an electronic shelving system in accordance with some embodiments.

FIG. 4 illustrates an electronic shelving system 400 in accordance with some embodiments.

As shown, the electronic shelving system 400 can include a proximity camera 407, a plurality of fasciae 408 (e.g., fascia 408*a*, fascia 408*b*, . . . , fascia 408*n*), a plurality of inventory cameras 410 (e.g., camera 410*a*, camera 410*b*, . . . , camera 410*n*), and a facial recognition camera 409 mounted on the shelving unit 100, which shelving unit 100, along with the coupling bracket 200, forms the cable management system set forth herein for managing cables associated with at least the foregoing camera and fasciae. It is noted that the disclosure is not limited to the electronic shelving system 400 including a single cabinet top display 406 but can include a plurality of cabinet top displays 406. Additionally, the electronic shelving system 400 is not limited to the number of fasciae, shelving units, proximity cameras, facial recognition cameras, or inventory cameras shown in FIG. 4. In some embodiments, the electronic shelving system 400 couples to the shelving unit 100, which includes the shelves 120 (e.g., shelf 120*a*, shelf 120*b*, . . . , shelf 120*n*), a back component 405 (e.g., pegboard, gridwall, slatwall, etc.), and the cabinet top display 406.

In one embodiment, the cabinet top display 406 is coupled to an upper portion of the shelving unit 100, extending vertically from the back component 405. Further, a proximity camera 407 can be positioned on top of, or otherwise affixed to, the cabinet top display 406. Although the proximity camera 407 is shown in FIG. 4 as being centrally positioned atop the cabinet top display 406, the proximity camera 407 can be positioned in different locations, such as near either end of the top of the cabinet top display 406, on a side of the cabinet top display 406 or at other locations coupled to the shelving unit 100 or the fasciae 408.

The cabinet top display 406 and fasciae 408 can be attached to the shelves 120 by way of any fastening means deemed suitable, wherein examples include, but are not limited or restricted to, magnets, adhesives, brackets, hardware fasteners, and the like. The fasciae 408 and the cabinet top display 406 can each include one or more arrays of light-emitting diodes ("LEDs" that are configured to display visual content (e.g., still or animated content), with optional speakers, not shown, coupled thereto to provide audio content. Any of the fasciae 408 or the cabinet top display 406 can include relatively smaller LED arrays that can be coupled together so as to tessellate the cabinet top display 406 and the fasciae 408, such that the fasciae 408 and cabinet top display 406 desirably extend along the length of the shelves 120. The smaller LED arrays can be of any number of LED pixels, which can be organized into any arrangement to conveniently extend the cabinet top display 406 and the fasciae 408 along the length of a plurality of shelves 120. In some embodiments, for example, a first dimension of the smaller LED arrays can include about 132 or more pixels. In some embodiments, a second dimension of the smaller LED arrays can include about 62 or more pixels.

The cabinet top display 406 and the fasciae 408 can be configured to display visual content to attract the attention of potential customers. As shown in FIG. 4, the cabinet top display 406 can display desired visual content that extends along the length of the shelves 120. The desired content can include a single animated or graphical image that fills the entirety of the cabinet top display 406, or the desired content can be a group of smaller, multiple animated or graphical images that cover the area of the cabinet top display 406. In some embodiments, the fasciae 408 can cooperate with the cabinet top display 406 to display either a single image or multiple images that appear to be spread across the height, length, or both the height and length of the shelves 120.

In some embodiments, the cabinet top display 406 can display visual content selected to attract the attention of potential customers to one or more products comprising inventory 412 (e.g., various types of merchandise such as inventory 412*a*, inventory 412*b*, . . . , inventory 412*n*) located on the shelves 120. Thus, the visual content shown on the cabinet top display 406 can be specifically configured to draw the potential customers to approach the shelves 120. The visual content and is often related to the specific inventory 412 located on the corresponding shelves 120. A similar configuration with respect to visual content displayed on the fasciae 408 can apply as well, as will be discussed below. The content shown on the cabinet top display 406, as well as the fasciae 408, can be dynamically changed to engage and inform customers of ongoing sales, promotions, and advertising. As will be appreciated, these features offer brands and retailers a way to increase sales locally by offering customers a personalized campaign that can be easily changed quickly.

Moreover, as referenced above, portions of the fasciae 408 can display visual content such as images of brand names or symbols representing products stocked on the shelves 120 nearest to each portion of the fasciae 408. For example, in an embodiment, a single fascia of the fasciae 408 can include a first portion 414 and a second portion 416. The first portion 414 can display an image of a brand name of inventory 412 that is stocked on the shelf above the first portion 414 (e.g., in one embodiment, stocked directly above the first portion 414), while the second portion 416 can display pricing information for the inventory 412. Additional portions can include an image of a second brand name or varied pricing information when such portions correspond to inventory different than inventory 412. It is contemplated, therefore, that the fasciae 408 extending along each of the shelves 120 can be sectionalized to display images corresponding to each of the products stocked on the shelves 120. It is further contemplated that the displayed images will advantageously simplify customers quickly locating desired products.

In an embodiment, the animated or graphical images displayed on the cabinet top display 406 and the fasciae 408 originate from media files that are executed by way of a suitable media player. The media player preferably is configured to simultaneously play any desired number of media files that can be displayed on the smaller LED arrays. In some embodiments, each of the smaller LED arrays can display one media file being executed by the multiplayer, such that a group of adjacent smaller LED arrays combine to display the desired images to the customer. Still, in some embodiments, base video can be stretched to fit any of various sizes of the smaller LED arrays or the cabinet top display 406 and fasciae 408. It should be appreciated, therefore, that the multiplayer disclosed herein enables implementing a single media player per aisle in-store instead relying on multiple media players dedicated to each aisle.

Furthermore, FIG. 4 illustrates a plurality of inventory cameras 410. In some embodiments, the inventory cameras 410 are coupled to the shelving unit 100 (e.g., by the back component 45 such as pegboard) and positioned above the inventory 412, also referred to herein as "inventory." Each of the inventory cameras 410 is configured to monitor a portion of the inventory stocked on each shelf of the shelves 120, and, in some instances, an inventory camera can be positioned below one of the shelves 120 (e.g., as is shown with the inventory cameras 410). However, in some instances, an inventory camera is not positioned below one of the shelves 120 as is shown with the inventory cameras 410*a* and 410*b*. Taking the inventory camera 410*d*, as an example, the inventory camera 410*d* is positioned above the second inventory portion 416 and therefore configured to and capable of monitoring the second inventory portion 416. Although, it should be noted that the inventory camera 410*d* can have a viewing angle of 180° and is capable of monitoring a larger portion of the inventory 412 on the shelf 404*b* than merely the second inventory portion 416.

In addition to the proximity camera 407 and the inventory cameras 410, the electronic shelving system 400 can include the facial recognition camera 409. In one embodiment, the facial recognition camera 409 can be coupled to the exterior of the shelving unit 100. In some embodiments, the facial recognition camera 409 can positioned five to six feet from the ground in order to obtain a clear image of the faces of a majority of customers. The facial recognition camera 409 can be positioned at heights other than five to six feet from the ground. The facial recognition camera 409 need not be coupled to the exterior of the shelving unit 100 as illustrated in FIG. 4; instead, the illustration of FIG. 4 is merely one embodiment. The facial recognition camera 409 can be coupled to in the interior of a side of the shelving unit 100, as well as to any portion of any of the shelves 120, the cabinet top display 406, the fasciae 408, or the back component 405 of the shelving unit 100. Further, a plurality of facial recognition cameras 409 can be coupled to the shelving unit 100.

In some embodiments, the electronic shelving system 400 can include one or more processors, a non-transitory computer-readable memory, one or more communication interfaces, and logic stored on the non-transitory computer-readable memory. The images or other data captured by the proximity camera 407, the facial recognition camera 409, or the inventory cameras 410 can be analyzed by the logic of the electronic shelving system 400. The non-transitory computer-readable medium can be local storage at the store in which the proximity camera 407, the facial recognition camera 409, or the inventory cameras 410 reside, or can be cloud-computing storage. Similarly, the one or more processors can be local to the proximity sensor 107, the facial recognition camera 109, or the inventory cameras 410 or can be provided by cloud computing services.

Examples of the environment in which the electronic shelving system 400 can be located include, but are not limited or restricted to, a retailer, a warehouse, an airport, a high school, college or university, any cafeteria, a hospital lobby, a hotel lobby, a train station, or any other area in which a shelving unit for storing inventory can be located.

Methods

A method for the electronic shelving system can include installing n coupling brackets such as the coupling bracket 200 in the shelving unit 100 of the electronic shelving system. Each coupling bracket 200 of the n coupling brackets can include the bracket-coupling body 210 with the one or more power couplers 220 and the one or more data couplers 230 disposed therein. The shelving unit 100 can include at least one slotted cable raceway such as the slotted cable raceway 140 between the pair of shelving standards 110 of the shelving unit 100. The method can further include running at least n+1 power cables or data cables through the slotted cable raceway 140 of the shelving unit 100 and coupling i) at least two power cables to each other through one of the power couplers 220 of the coupling bracket 200 or ii) at least two data cables to each other through one of the data couplers 230 of the coupling bracket 200.

Each coupling bracket 200 of the n coupling brackets can further include the tongue 240 integral with the bracket-coupling body 210. Installing the n coupling brackets can include inserting the tongue 240 of each coupling bracket 200 into a slot 142 of the slotted cable raceway 140 of the shelving unit 100.

Each coupling bracket 200 of the n coupling brackets can further include the power-coupler side piece 214 of the bracket-coupling body 210 having the relatively wide-toothed cable comb 213 and data-coupler side piece 216 of the bracket-coupling body 210 having the relatively narrow-toothed cable comb 219. Coupling the at least two power cables or data cables to each other can include threading an end portion of a power cable through the relatively wide-toothed cable comb 213 or an end portion of a data cable through the relatively narrow-toothed cable comb 29. Threading the cables through the combs can mitigate tensile stress placed on the couplers from cable weight or inadvertent cable pulling. For example, threading an end portion of a power cable through the relatively wide-toothed cable comb 213 can mitigate tensile stress placed on the power coupler to which the power cable is attached from the weight of the power cable or inadvertent pulling of the power cable by an individual. Likewise, threading an end portion of a data cable through the relatively narrow-toothed cable comb 219 can mitigate tensile stress placed on the data coupler to which the data cable is attached from the weight of the data cable or inadvertent pulling of the data cable by an individual.

While some particular embodiments have been disclosed herein, and while the particular embodiments have been disclosed in some detail, it is not the intention for the particular embodiments to limit the scope of the concepts provided herein. Additional adaptations or modifications can appear to those of ordinary skill in the art, and, in broader aspects, these adaptations and/or modifications are encompassed as well. Accordingly, departures can be made from the particular embodiments disclosed herein without departing from the scope of the concepts provided herein.

What is claimed is:

1. A coupling bracket of an electronic shelving system, comprising:

a 'U'-shaped bracket-coupling body comprising an end piece between two side pieces, wherein each side piece of the two side pieces comprises an integrated cable comb with slots configured to receive one or more cables;

one or more power couplers disposed in the end piece of the bracket-coupling body;

one or more data couplers disposed in the bracket-coupling body; and one or more integral fasteners extending from the bracket-coupling body configured for fastening the coupling bracket to a shelving unit of the electronic shelving system;

a power-coupler side piece of the two side pieces is adjacent at least one of the one or more power couplers, and wherein the power-coupler side piece comprises a wide-toothed cable comb configured to receive one or more power cables;

wherein a data-coupler side piece of the two side pieces is adjacent at least one of the one or more data couplers, and wherein the data-coupler side piece comprises a relatively narrow-toothed cable comb configured to receive one or more data cables.

2. The coupling bracket of claim 1, wherein the one or more integral fasteners is a tongue configured to be inserted into a slot of a slotted cable raceway of a shelving unit of the electronic shelving system.

3. An electronic shelving system, comprising:

a shelving unit of the electronic shelving system; and one or more coupling brackets of the electronic shelving system, wherein each coupling bracket includes a bracket-coupling body, comprising a 'U'-shape with an end piece between two side pieces;

a power-coupler side piece of the two side pieces is adjacent at least one of the one or more power couplers, and wherein the power-coupler side piece comprises a wide-toothed cable comb configured to receive one or more power cables;

one or more power couplers disposed in the bracket-coupling body, one or more data couplers disposed in the bracket-coupling body, and one or more integral fasteners extending from the bracket-coupling body configured for fastening the coupling bracket to the shelving unit of the electronic shelving system.

4. The electronic shelving system of claim 3, wherein the one or more power couplers and the one or more data couplers are disposed in the end piece of the bracket-coupling body.

5. The electronic shelving system of claim 3, wherein each side piece of the two side pieces includes an end portion having a cutaway to facilitate fastening the coupling bracket to the shelving unit of the electronic shelving system.

6. The electronic shelving system of claim 3, wherein the shelving unit includes at least a pair of shelving standards configured to hold brackets for shelves or shelves with integrated brackets, and at least one slotted cable raceway between the pair of shelving standards.

7. The electronic shelving system of claim 6, wherein the one or more integral fasteners is a tongue configured to be inserted into any slot of the slotted cable raceway of the shelving unit.

8. The electronic shelving system of claim 7, wherein an end portion of the tongue is angled away from the bracket-coupling body to facilitate insertion of the tongue into the slot of the slotted cable raceway of the shelving unit.

9. The electronic shelving system of claim 3, wherein each side piece of the two side pieces includes an integrated cable comb with slots configured to receive one or more cables.

10. The electronic shelving system of claim 9, wherein a power-coupler side piece of the two side pieces is adjacent at least one of the one or more power couplers, and wherein the power-coupler side piece includes a relatively wide-toothed cable comb configured to receive one or more power cables.

11. The electronic shelving system of claim 10, wherein a data-coupler side piece of the two side pieces is adjacent at least one of the one or more data couplers, and wherein the data-coupler side piece includes a relatively narrow-toothed cable comb configured to receive one or more data cables.

12. A method for an electronic shelving system, comprising:

installing n coupling brackets in a shelving unit of the electronic shelving system, wherein each coupling bracket of the n coupling brackets includes a bracket-coupling body with one or more power couplers and one or more data couplers disposed therein, and wherein the shelving unit includes at least one slotted cable raceway between a pair of shelving standards of the shelving unit;

running at least n+1 power cables or data cables through the slotted cable raceway of the shelving unit; and coupling i) at least two power cables to each other through a power coupler of a coupling bracket or ii) at least two data cables to each other through a data coupler of the coupling bracket;

wherein each coupling bracket of the n coupling brackets comprises:

a tongue integral with the bracket-coupling body, wherein installing the n coupling brackets includes inserting the tongue of each coupling bracket into a slot of the slotted cable raceway of the shelving unit; and a power-coupler side piece of the bracket-coupling body having a relatively wide-toothed cable comb and data-coupler side piece of the bracket-coupling body having a relatively narrow-toothed cable comb, wherein coupling the at least two power cables or data cables to each other includes threading an end portion of a power cable through the relatively wide-toothed cable comb or an end portion of a data cable through the relatively narrow-toothed cable comb.

* * * * *